US006471555B2

(12) United States Patent
Creze

(10) Patent No.: US 6,471,555 B2
(45) Date of Patent: Oct. 29, 2002

(54) FEMALE ELECTRICAL CONNECTOR ELEMENT

(75) Inventor: Fabrice Creze, Les Authieux Port St Ouen (FR)

(73) Assignee: Hypertac S.A., Saint Aubin les Elbeuf (FR)

( * ) Notice: Subject to any disclaimer, the term of this patent is extended or adjusted under 35 U.S.C. 154(b) by 0 days.

(21) Appl. No.: 09/861,518

(22) Filed: May 22, 2001

(65) Prior Publication Data

US 2002/0016108 A1 Feb. 7, 2002

(30) Foreign Application Priority Data

May 22, 2000 (FR) ..... 00 06522

(51) Int. Cl.[7] ..... H01R 13/33
(52) U.S. Cl. ..... 439/843; 439/851; 439/841
(58) Field of Search ..... 439/841, 842, 439/843, 851

(56) References Cited

U.S. PATENT DOCUMENTS 2,394,020 A * 2/1946 Sorent ..... 173/363
3,861,776 A * 1/1975 Deal ..... 339/74
4,245,881 A * 1/1981 Michaels ..... 339/256
4,632,496 A 12/1986 Williams ..... 439/843
5,906,520 A 5/1999 Frinker et al. ..... 439/841

FOREIGN PATENT DOCUMENTS

| | | |
|---|---|---|
| DE | 19 34 580 | 2/1971 |
| FR | 2 709 024 | 2/1995 |

* cited by examiner

*Primary Examiner*—P. Austin Bradley
*Assistant Examiner*—Alexander Gilman
(74) *Attorney, Agent, or Firm*—Young & Thompson

(57) ABSTRACT

A female electrical connector includes a socket (1) made of conducting material, defining an approximately cylindrical internal space (2) open at one of its ends, inside of which plural wire contacting components made of a conducting material are placed, these being intended to grip, flexibly, a male component to be inserted into the socket (1), the plural components each extending from one end of the cylindrical space (2) to the other. The wire contacting components are formed from a single wire (4).

12 Claims, 2 Drawing Sheets

FEMALE ELECTRICAL CONNECTOR ELEMENT

BACKGROUND OF THE INVENTION

The invention relates to the field of electrical connectors. More specifically, it relates to the female components of electrical connectors, of the type comprising a socket defining an approximately cylindrical internal space inside which wire contacting elements are placed, these being intended to grip, flexibly, the male component of the said connector, which has to be inserted into the said socket.

The prior art teaches of electrical connectors whose female component is composed of:

- a socket defining an approximately cylindrical internal space into which the male part of the electrical connection is intended to be inserted;
- a multiplicity of conductor wire elements, each of the ends of which is anchored to a rim made at a different end of the internal cylindrical space of the socket.

It is usual to angularly offset, one with respect to the other, the respective anchoring points of the two ends of each wire. Thus, an internal space, defined by the set of wires, which has a barrelled shape (called "hyperboloidal" shape) is obtained. The effect of this barrelling is that the set of wires can grip, in a firm but flexible manner, the male component after it has been inserted into the female component. When the connector is subjected to shocks or vibrations resulting in movements of the male component inside the female component, the multiplicity of wires and the flexibility of their contact with the male component of the connector ensure that, despite the movements of this male component, its contact with at least some of the wires is always maintained. The reliability of the electrical connection thus produced is therefore guaranteed. In this way, it is possible for the duration of possible interruptions in the electrical contact to be less than $10^{-9}$ s, which value corresponds to the level of detectability of such interruptions.

Such connectors are described, for example, in documents U.S. Pat. No. 3,023,789, U.S. Pat. No. 3,107,966, U.S. Pat. No. 3,470,527, U.S. Pat. No. 3,557,428 and U.S. Pat. No. 3,858,962.

These connectors are used in the aeronautical, military and railway fields in particular, in which the integrity and the constancy of the electrical contact are absolutely fundamental, particularly when the item which contains them is subjected to intense vibrations. These connectors may be produced in an extremely wide range of dimensions. They may be constructed so as to accommodate male components having diameters of the order of 10 cm or more, but also male components having diameters of the order of 0.3 mm. It is commonplace to produce such connectors able to accommodate male components having diameters from 1 to 2 mm. The wire components of the female component of the electrical connector may have a minimum diameter of 85 $\mu$m, this being for the smallest connectors available on the market. The number of these wire components can vary, commonly amounting to five or six wires per connector.

These connectors therefore are extremely reliable, but have the drawback of being very expensive to produce, particularly the smallest of them. The solid elements of the female component of the connector are manufactured by screw-machining, and conventionally assembly of three different elements is needed to produce a socket allowing the wire components to be mounted in the manner described. Another difficult and expensive operation is fastening the wire components to the socket, particularly in the case of connectors having the smallest dimensions.

SUMMARY OF THE INVENTION

It is an object of the invention to provide a configuration of female components of electrical connectors of a type functionally similar to that described above but having an appreciably lower manufacturing cost.

For this purpose, the subject of the invention is a female electrical connector component of the type comprising a socket made of conducting material, defining an approximately cylindrical internal space open at one of its ends, inside which wire contacting components made of a conducting material are placed, these being intended to grip, flexibly, the male component of the said connector to be inserted into the said socket and extending from one end of the said cylindrical space to the other, characterized in that the said wire contacting components are formed from a single wire.

Preferably, the said single wire is shaped into a succession of approximately straight parts inclined at an angle $\alpha$ with respect to a central axis and the internal envelope of which defines an annular space centred on the said central axis.

In a preferred embodiment, the said successive approximately straight parts of the said single wire are joined by two bent portions separated by a portion lying approximately in an end plane of the conformation of the said single wire.

In another embodiment, the said successive approximately straight parts of the said single wire are joined by a single bent portion.

The single wire is held in place in the said internal space of the socket merely by its elasticity.

The single wire is also held in place in the said internal space of the socket by holding means.

The said holding means consist of a snap-riveting of the open end of the socket.

Preferably, the socket is formed by a single element.

As will have been understood, the invention essentially consists in replacing the multiple wire components providing contact between the female component and the male component of electrical connectors of the known type described above with a single wire, shaped suitably so as to grip, flexibly, the male component of the connector. After this single wire has been shaped, it is inserted into the approximately cylindrical internal space of a socket, which may itself now consist of a single component. Thus, the manufacture and assembly of the various parts making up the female component of the electrical connector are appreciably simplified.

BRIEF DESCRIPTION OF THE DRAWINGS

The invention will be more clearly understood on reading the description which follows, given with FIG. 1 shows schematically, in a partially cut-away view, an illustrative example of a female electrical connector component according to the invention and the male component of the connector ready to be inserted thereinto.

DESCRIPTION OF THE PREFERRED EMBODIMENTS

Figure 1:
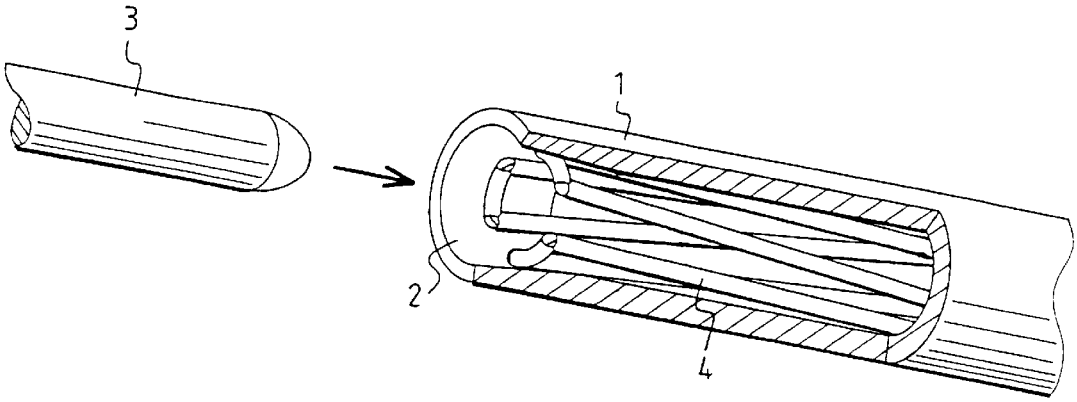

The female electrical connector component according to the invention comprises, as shown in FIG. 1, a socket 1 made of a conducting material, such as copper or a copper alloy. Unlike the sockets of female components of electrical connectors of the prior art, to which reference has been made above, this socket 1 consists, in the example shown, of a single part. This defines an approximately cylindrical internal space 2, open at one of its ends. On the outside, this socket 1 may have any shape suitable for it to be fitted into the electrical device for which it is intended, the possible details of which have not been shown in FIG. 1.

This socket 1 is intended to accommodate a male component 3 of the electrical connector. This male component 3 has, in the example shown, an overall approximately cylindrical shape and can be inserted into the internal space 2 of the socket 1. In general, it may have any shape known per se suitable for this insertion.

According to the invention, contact between the male component 3 and the female component of the connector is provided by means of a wire 4 placed in the internal space 2 of the socket 1. According to the prior art described above, this wire 4 provides electrical contact between the male component 3 and the female component of the connector by gripping, flexibly, the male component 3 via wire components. However, unlike the connectors of the prior art, a single wire 4, shaped in the manner that will now be described, is used here to produce the said wire components.

In general, this single wire 4 is shaped into a succession of parts of approximately straight orientations, which are inclined at an angle $\alpha$ to a central axis. The outer envelope of the single wire 4 thus shaped defines a shape such as a cylinder or a similar shape, making it possible for it to be inserted into the internal space 2 of the socket 1. Likewise, the single wire 4 thus shaped defines an annular internal space 5, the smallest dimension of the cross section of which, when the connector is not in use, is less than the maximum diameter of the male component of the connector. In this way, when the male component 3 of the connector is inserted into the female component according to the invention, it tends to separate the various straight portions of the wire 4 by virtue of the elastic properties of the wire 4 thus shaped. Since, because of its elasticity, the wire 4 tends to resume its initial shape, the male component 3 is thus gripped both flexibly and firmly by the wire 4, in a manner similar to that which occurs with the multiple separate wire components mounted in the female components of the electrical connectors of the prior art. Thus, when the connector in the working position is subject to vibrations and the male component is liable to move inside the female component, it will always be guaranteed that there will be permanently at least one (and in general several) straight portions of the wire 4 in contact with the male component 3 of the connector, and that the constancy of the contact with the connector will always be guaranteed.

Figure 2B:
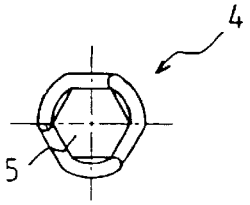
FIG. 2 shows, in an end view (FIG. 2A), a top view (FIG. 2B) and a perspective view (FIG. 2C), a first embodiment of a single wire intended to grip the male component of the electrical connector.
Figure 2A:
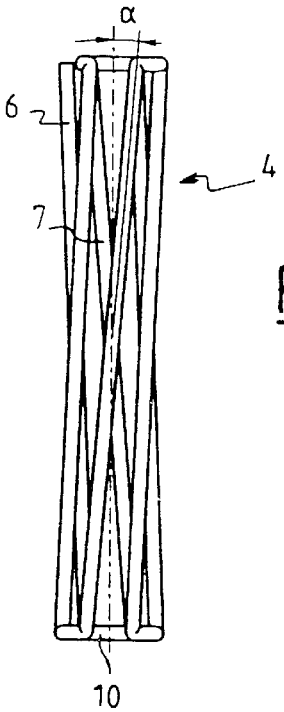
Figure 2C:
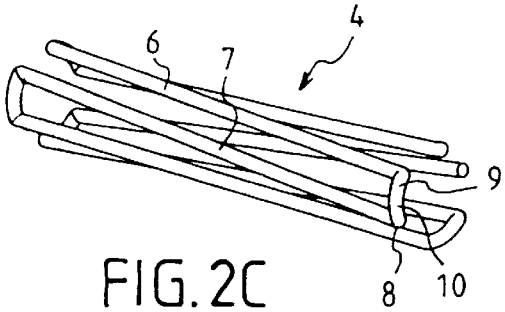

FIG. 2 shows a first embodiment of the wire 4 of the female connector component according to the invention.

According to this variant, which is that given as an example also in FIG. 1, two successive approximately straight portions 6, 7 of the wire 4 are joined by two bent portions 8, 9, which are themselves joined together by a portion 10 lying approximately in an end plane of the conformation of the wire 4. With this type of conformation, the internal space 5 defined by the wire 4 has a cross section of approximately polygonal shape, as may be seen in FIG. 2B. This confirmation of the wire 4 has many similarities with the hyperboloidal arrangement of the multiple wires with which the electrical connectors of the prior art, as described in the abovementioned documents, are equipped.

Figure 3A:
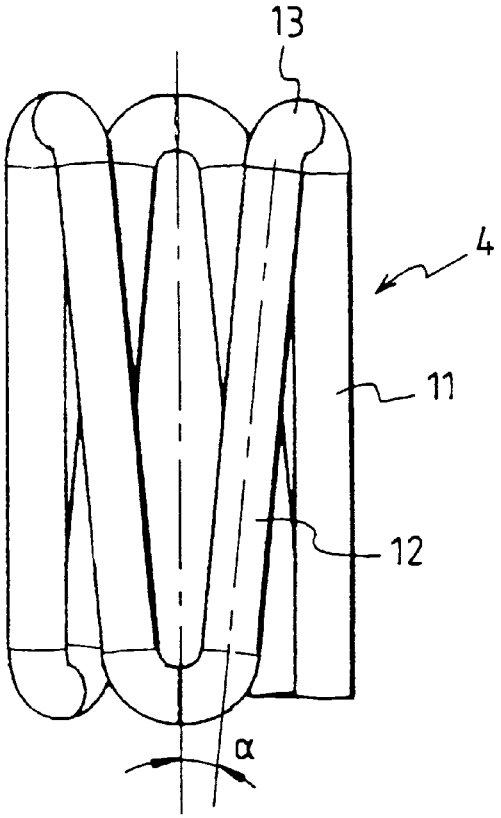
FIG. 3 shows, in an end view (FIG. 3A), a top view (FIG. 3B) and a perspective view (FIG. 3C), a second embodiment of the single wire intended to grip the male component of the electrical connector.
Figure 3B:
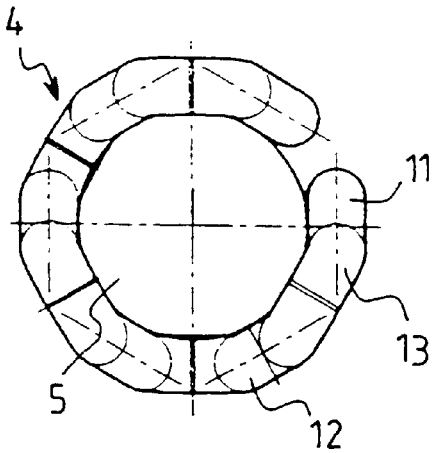
Figure 3C:
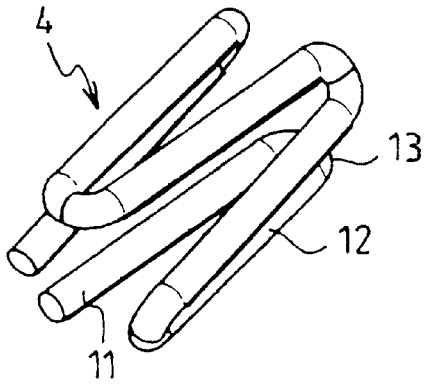

According to a second embodiment variant of the invention, shown in FIG. 3, the wire 4 is shaped so as to have a succession of approximately straight portions 11, 12 which, here again, are inclined at an angle $\alpha$ to a central axis of the conformation of the wire. But, unlike the conformation described above and shown in FIG. 2, these approximately straight portions 11, 12 are connected to each other by a single bent portion 13. This has the consequence that the internal space 5 defined by the conformation of the wire 4 has a practically circular cross section (see FIG. 3B). Here again, in order for the electrical connector to be functional, it is necessary, when the female component is not in use, for the diameter of this internal space 5 to be less than the external diameter of the male component 3 of the connector intended to be inserted thereinto.

The conformational variants of the wire 4 which have just been described and are shown in the figures are, of course, only examples of implementation of the invention. Without departing from the scope of the invention, further conformational variants of the wire 4 that can provide the functions that have been mentioned may be imagined.

The wire 4 may be held inside the socket 1 merely due to its dimensions and its elasticity, which tend to press it against the wall of the internal space 2 of the socket 1, at least when the male component 3 of the connector has been inserted thereinto. However, it is also possible to provide in the socket 1 means for holding the wire 4 in position. These means may, for example, consist of a snap-riveting of the open end of the socket 1 after the wire 4 has been inserted. This snap-riveting must reduce the diameter of the open end of the internal space 2 of the socket 1 to a value less than the external diameter of the shaped wire 4. In this way, the wire 4 is prevented from escaping from the socket 1. of course, this diameter of the open end of the socket 1 must remain greater than the largest diameter of the male component 3 of the connector.

As described and shown, the socket 1 may preferably consist of a single component. This makes it particularly inexpensive to manufacture compared with the known sockets of the prior art which consist of an assembly of many parts. However, it would of course remain within the scope of the invention for the socket 1 to consist of an assembly of several parts. Replacing the set of wire components of the connectors of the prior art with a single shaped wire 4 as described constitutes, by itself, an appreciable improvement in that it very substantially simplifies the manufacture of the female component of the connector.

The number of straight portions of the wire 4 may be of the same order of magnitude as the number of separate wire components of the connectors of the prior art. In the examples shown, the wire 4 comprises six such straight portions (6, 7; 11, 12), but this number is not limiting.

The wire may be made of any material known for producing the wire components of the connectors according to the prior art. For example, mention may be made of phosphor bronzes and copper-beryllium alloys. As is known, the socket 1 and the wire 4 may be coated with nickel, and also with a thin deposit of gold on their electrically active portions.

A female electrical connector component according to the invention may thus be produced which corresponds to the usual dimensions of the connectors known in the prior art.

What is claimed is:

1. A female electrical connector component comprising:

a socket (1) made of conducting material, defining an approximately cylindrical internal space (2) open at one of its ends; and plural straight wire contacting components inside said internal space that are made of a conducting material and that are arranged to grip, flexibly, a male component (3) to be inserted into said socket (1), each of said straight components extending from one end of the said cylindrical space (2) to the other, wherein said wire contacting components are formed from a single wire (4).

2. The female electrical connector component according to claim 1, wherein said single wire (4) is held in place in said internal space (2) of the socket (1) merely by its elasticity.

3. The female electrical connector component according to claim 1, wherein said single wire (4) is held in place in said internal space (2) of the socket (1) by holding means.

4. The female electrical connector component according to claim 1, wherein the single wire has a generally round cross section.

5. The female electrical connector component according to claim 1, wherein said socket (1) is formed by a single component.

6. The female electrical connector component according to claim 1, wherein said single wire (4) is coiled and has a succession of approximately straight parts (6, 7; 11, 12) inclined at an angle ($\alpha$) with respect to a central axis of said internal space and that define an annular space (5) centered on said central axis.

7. The female electrical conductor component according to claim 6, wherein said successive approximately straight parts (7) of said single wire (4) are joined by two bent portions (8, 9) separated by a portion (10) lying approximately parallel to an end plane of said internal space.

8. The female conductor component according to claim 6, wherein said successive approximately straight parts (11, 12) of said single wire are joined by a single bent portion (13).

9. A female electrical connector, comprising:

an electrically conductive socket that defines a generally cylindrical internal space, said internal space having two longitudinally distal ends, one of said two distal ends being open; and a single electrically conductive wire with a generally round cross section that is coiled to define an annular opening inside said internal space, said single wire having plural straight sections, each of said plural straight sections extending substantially longitudinally in said internal space from said one of said two distal ends to an opposite one of said two distal ends, said annular opening being arranged and adapted to receive a male electrical connector at said one of said two distal ends that is open.

10. The connector of claim 9, wherein said straight sections are offset from a direction of a longitudinal axis of said internal space by an angle $\alpha$.

11. The connector of claim 10, wherein, at each of said two distal ends, every other pair of adjacent ends of said straight sections are joined to each other by a respective further section that is generally orthogonal to the direction of the longitudinal axis of said internal space and that conforms to a curve of a periphery of said internal space.

12. The connector of claim 10, wherein, at each of said two distal ends, every other pair of adjacent ends of said straight sections are joined to each other by a respective U-shaped section.

* * * * *